US006854303B2

(12) United States Patent
Shiao et al.

(10) Patent No.: US 6,854,303 B2
(45) Date of Patent: Feb. 15, 2005

(54) TORQUE RESISTANT SECURITY CASING FOR A PADLOCK

(75) Inventors: Ming Liang Shiao, Anaheim, CA (US); Frank Minnella, Murrieta, CA (US)

(73) Assignee: Lock America, Inc., Garden Grove, CA (US)

( * ) Notice: Subject to any disclaimer, the term of this patent is extended or adjusted under 35 U.S.C. 154(b) by 222 days.

(21) Appl. No.: 10/324,232

(22) Filed: Dec. 19, 2002

(65) Prior Publication Data

US 2004/0244442 A1 Dec. 9, 2004

Related U.S. Application Data

(63) Continuation-in-part of application No. 09/734,491, filed on Dec. 11, 2000, now abandoned.

(51) Int. Cl.[7] ..... E05B 67/38

(52) U.S. Cl. ..... 70/56; 70/2; 70/34; 70/417; 70/381

(58) Field of Search ..... 70/416, 417, 54–56, 70/381, 32–34, 423, 2

(56) References Cited

U.S. PATENT DOCUMENTS

| | | | | | |
|---|---|---|---|---|---|
| 1,652,234 | A | * | 12/1927 | Bronson et al. | 70/221 |
| 3,343,386 | A | * | 9/1967 | Hall | 70/423 |
| 3,630,054 | A | * | 12/1971 | Malminen et al. | 70/452 |
| 3,751,953 | A | * | 8/1973 | Newman | 70/381 |
| 3,820,360 | A | * | 6/1974 | Best | 70/6 |
| 4,676,084 | A | * | 6/1987 | Signorelli | 70/440 |
| 4,754,626 | A | * | 7/1988 | Siegel | 70/32 |
| 5,010,745 | A | * | 4/1991 | Hall et al. | 70/32 |
| 5,063,765 | A | * | 11/1991 | Squire et al. | 70/417 |
| 5,172,574 | A | * | 12/1992 | Perfetto | 70/56 |
| 5,199,285 | A | * | 4/1993 | Lin | 70/220 |
| 5,345,794 | A | * | 9/1994 | Jenks | 70/14 |
| 5,351,513 | A | * | 10/1994 | Ellis | 70/370 |
| 5,469,722 | A | * | 11/1995 | Ellefsen | 70/56 |
| 5,669,255 | A | * | 9/1997 | Albano | 70/56 |
| 5,761,937 | A | * | 6/1998 | Adelmeyer | 70/370 |
| 5,813,261 | A | * | 9/1998 | Boehlow | 70/379 R |
| 5,913,907 | A | * | 6/1999 | Lee | 70/58 |
| 5,946,952 | A | * | 9/1999 | Mintchenko | 70/2 |
| 6,146,070 | A | * | 11/2000 | Koma | 411/5 |
| 6,324,879 | B1 | * | 12/2001 | Kennedy | 70/416 |
| 6,338,261 | B1 | * | 1/2002 | Liu | 70/34 |
| 6,397,647 | B1 | * | 6/2002 | Kuo | 70/423 |
| 6,467,317 | B1 | * | 10/2002 | Hillabush et al. | 70/56 |
| 2003/0217575 | A1 | * | 11/2003 | Price | 70/493 |

* cited by examiner

*Primary Examiner*—Suzanne Dino Barrett
(74) *Attorney, Agent, or Firm*—Marvin H. Kleinberg; Marshall A. Lerner; Kleinberg & Lerner, LLP

(57) ABSTRACT

A security lock and encasement providing resistance to torquing moment with a slip ring designed to slide onto the padlock encasement from the back without being able to advance beyond the front face of the encasement. Said slip ring is designed such that it can only be applied or removed to the lock casing from the back of the casing and is properly aligned with said encasement through a setscrew that will break if sufficient torque is applied.

5 Claims, 5 Drawing Sheets

TORQUE RESISTANT SECURITY CASING FOR A PADLOCK

This application is a Continuation-In-Part of a Non-Provisional application filed on Dec. 11, 2000 now ABN having U.S. application Ser. No. 09/734,491, the priority of which is claimed.

BACKGROUND

1. Field of the Invention

The present invention relates generally to the field of padlocks, and more specifically to a torque-resistant protective case enclosing a lock and a shackle.

2. Prior Art

While padlocks generally provide a measure of security for articles being protected, they have not been a completely effective deterrent in outdoor areas prone to vandalism or in areas requiring higher security against that kind of destructive activity. In most applications, a common padlock is vulnerable to cutting tools that can cut the shackle or to other tools, such as a pipe wrench, that can break the shackle, hasp or lock through torque. Historically, the shackle has been the most vulnerable portion of the padlock.

A development towards protecting the shackle was seen in U.S. Pat. No. 3,835,675 issued to Lippisch. Lippisch extended the encasing portion of the lock to cover a portion of the shackle. However, this design still left the shackles partially exposed and accessible to cutting tools. Thus, this device provided only a small amount of additional security over existing technology.

Further technical advances came when the entire lock and shackle were enclosed in a cylindrical casing. The casing caused the shackle to be covered when the lock was in use and attempted to prevent access to the protected object via cutting the shackle. Several fully encased padlocks are known in prior art. These generally include a hard, fixed casing that completely covers the shackle and are described in U.S. Pat. No. 6,338,261(Liu) and U.S. Pat. No. 5,345,794 (Jenks), incorporated herein by reference.

These designs solved the security problem that was caused by partially exposed shackles. However, because the design of the padlock called for the casing to be rigidly affixed to the lock, it left the lock, hasp or shackle vulnerable to attack by the application of torque, through a pipe wrench or other similar instrument. Thus, the new lock design fully enclosing the shackles was only marginally effective in deterring vandalism.

In further developments, guards and encasements were added to negate the torquing problem. The "guard approach" generally involved a guard that covered the approach to the lock, but was not integrated into the lock encasement (U.S. Pat. No. 5,172,574 to Perfetto and U.S. Pat. No. 5,469,722 to Ellefsen). A rotating encasement approach is exemplified in U.S. Pat. No. 3,820,360 (Best) or U.S. Pat. No. 5,669,255 (Albano), showing a freely rotating encasement. This approach addressed the torquing problem, but left the lock subject to vandalism because the rotating encasement could be easily rotated to a position where the keyhole was covered and then the encasement affixed to that position. Additionally, the freely rotating design often left the keyhole and the encasement hole misaligned, causing an inconvenience to the lock user.

However, none of the prior art has resolved the problem of protecting the hasp, which is the weakest part of the lock protection. The problem with breaking the hasp to gain entry into a locked object is that 1) unauthorized entry is allowed and 2) the process damages the thing to be protected. Thus, as vending machines become more expensive, it becomes increasingly important to protect them from damage through unauthorized entry.

Therefore, what has been needed is a padlock that is resistant to cutting, resistant to the application of torque and easy to install and use.

BRIEF SUMMARY OF THE INVENTION

According to the present invention, a padlock is described that is resistant to attach through the application of torque and is easier to use than prior art. In the preferred embodiment, a locking mechanism is housed in a cylindrical casing that encloses the locking mechanism and partially encloses the lock's shackles. The sidewall of the casing is covered by a slip ring to prevent the destruction of the lock through rotational force. When affixed to the casing, the slip ring is prevented from forward axial movement by the cooperation of offsetting outer diameters of the lock casing and the inner diameters of the slip ring. It is prevented from axial movement backwards in part by the fact that the back surface of the lock assembly abuts an immovable surface. When installed, the slip ring is inhibited from further rotational movement by a small setscrew or similar device that breaks with the application of sufficient torque. The location of the setscrew and threaded opening to receive the screw aligns the keyhole opening of the slip ring with the keyhole opening of the casing, thereby making the lock easier to use.

To date, the lock has been extremely well received in the marketplace after independent testing because of the lock's ability to prevent entry by breaking the hasp. In testing in high crime areas, the invention claimed herein proved to be the only lock that did not succumb to vandalism and/or attack. Prior art lock technology in these areas had been inadequate to prevent vending machine vandalism.

It is therefore an object of the present invention to provide a lock that both protects the shackles and secures the lock against breakage by torque.

It is a further object of the present invention to provide a lock that is resistant to torque forced tampering through the use of a rotatable encasement/slip ring.

Further features and advantages of the present invention will be appreciated by reviewing the following drawings and detailed description of the invention.

BRIEF DESCRIPTION OF THE DRAWINGS

For a further understanding of the objects and advantages of the present invention, reference should be made to the following detailed description, taken in conjunction with the accompanying drawing(s), in which like parts are given like reference numbers and wherein.

DETAILED DESCRIPTION OF THE INVENTION

A novel torque-resistant security casing for a secure lock is described. In the following description, for the purposes of explanation, specific component arrangements, constructions and other details are set forth in order to provide a more thorough understanding of the present invention. It will be apparent to those skilled in the art, however, that the present invention may be practiced without these specific details. In other instances, well known manufacturing methods and structures have not been described in detail so as not to obscure the details of the present invention unnecessarily.

Figure 1:
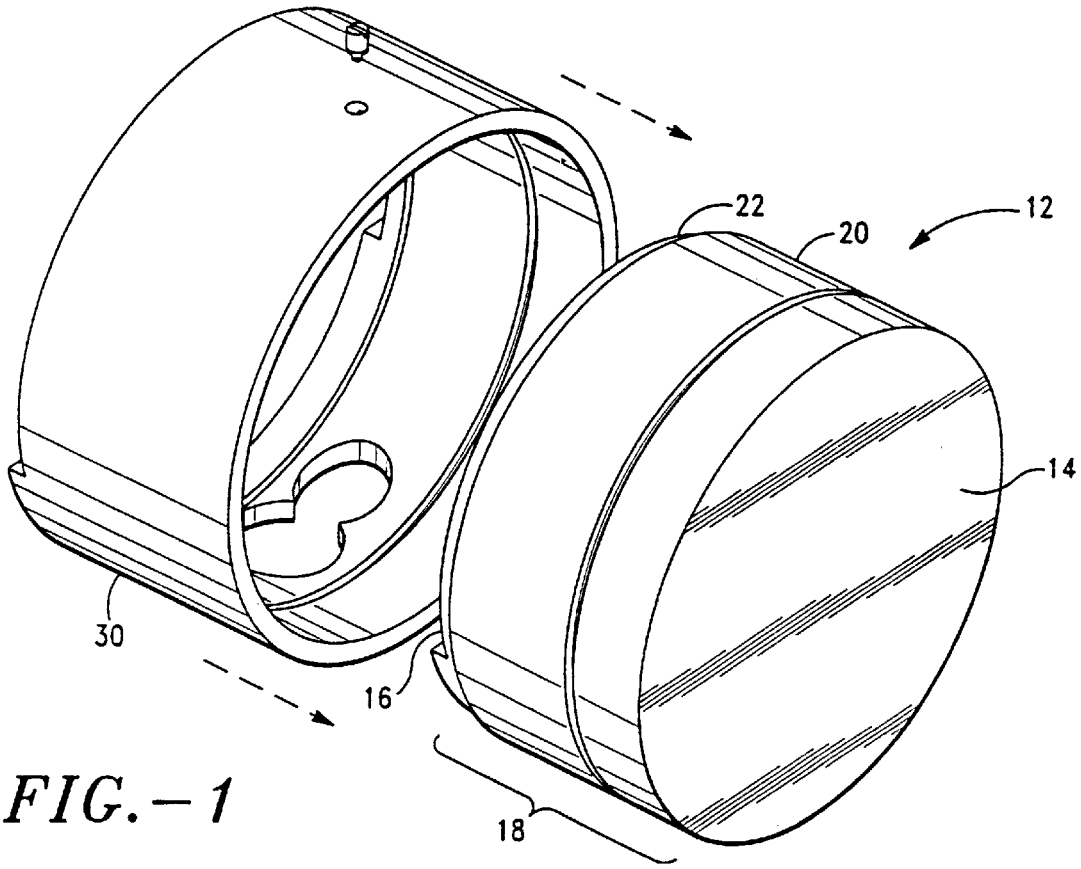
FIG. 1 presents a perspective, from the front, of the lock casing and the slip ring.

Referring to FIG. 1, a lock generally referred to with numeral 10 (not shown) is enclosed within a cylindrical padlock casing 12 having a front face 14, a rear face 16 and a sidewall 18. The sidewall 18 of the casing 12 has a first larger diameter 20 and a second smaller diameter 22. The first and second diameters 20, 22 combine with circumference differentials within the slip ring 30 to prevent further forward axial movement of the slip ring 30 when the slip ring 30 is placed onto the casing 12 in a rear to forward axial movement. Because of the differing circumferences of the lock casing 12 and the slip ring 30, the slip ring 30 is unable to slide onto said casing 12 in a forward to rear axial movement. In the embodiment shown, the circumferences 20, 22 are positioned towards the rear edge of the sidewall 18. In an alternative embodiment, the differential circumferences 20, 22 are positioned towards the front edge of the sidewall 18. While size is not a limiting factor in the invention, the preferred embodiment lock casing 12 has a diameter of approximately four inches. The material composition of the casing 12 is not a limiting factor of the invention either. However, in the preferred embodiment, the casing 12 is made of case hardened steel.

Figure 2:
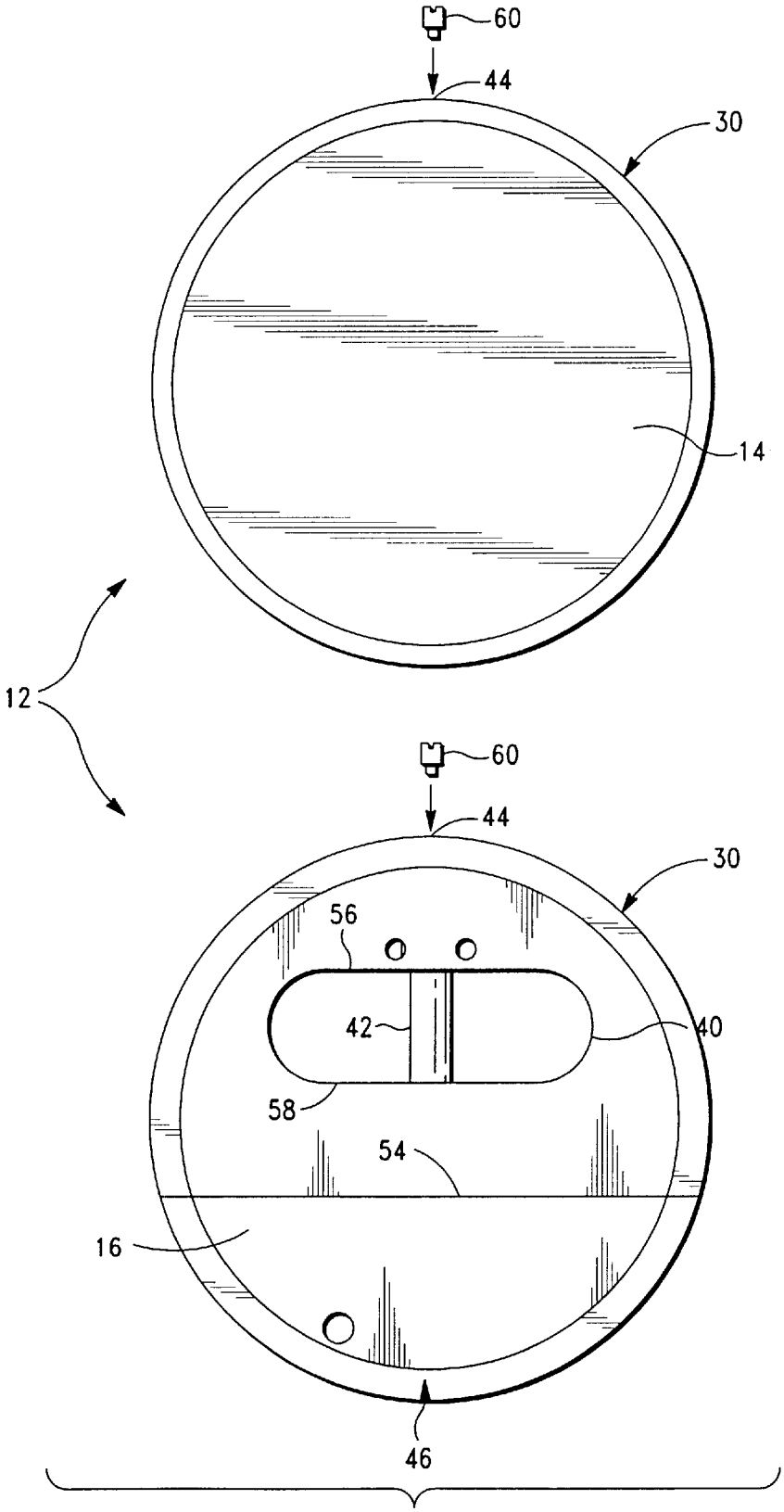
FIG. 2 presents a the rear elevations of the slip ring and lock casing of FIG. 1.

Referring next to FIG. 2, the front face 14 of the casing 12 is circular and has solid surface without any openings. The rear face 16 of the casing 12 is circular and has a slightly smaller circumference than the front face 14. The rear face 16 also has an oblong shaped shackle cut-out 40 in the opening to the rear face 16 of the casing 12 to allow a single I-shaped shackle 42 to project vertically within the shackle cut out 40. The casing 12 surrounds and encloses the locking mechanism (seen as an outlined figure in FIG. 5), which is rigidly affixed inside the casing 12. The casing 12 has a cavity (not shown) extending inward from the sidewall 18 (best seen in FIG. 1) to allow for the placement of a keyed tumbler cylinder locking mechanism. The keyed tumbler locking mechanism is maintained within the cavity (not shown) of the casing 12 and includes a shackle 42 and a lock housing (not shown). The shackle 42 is a single I-shaped shackle that projects from the bottom of the shackle cut out 58 upwards through the top of the shackle cut out 56. A slip ring 30 encircles the lock casing 12.

Figure 3:
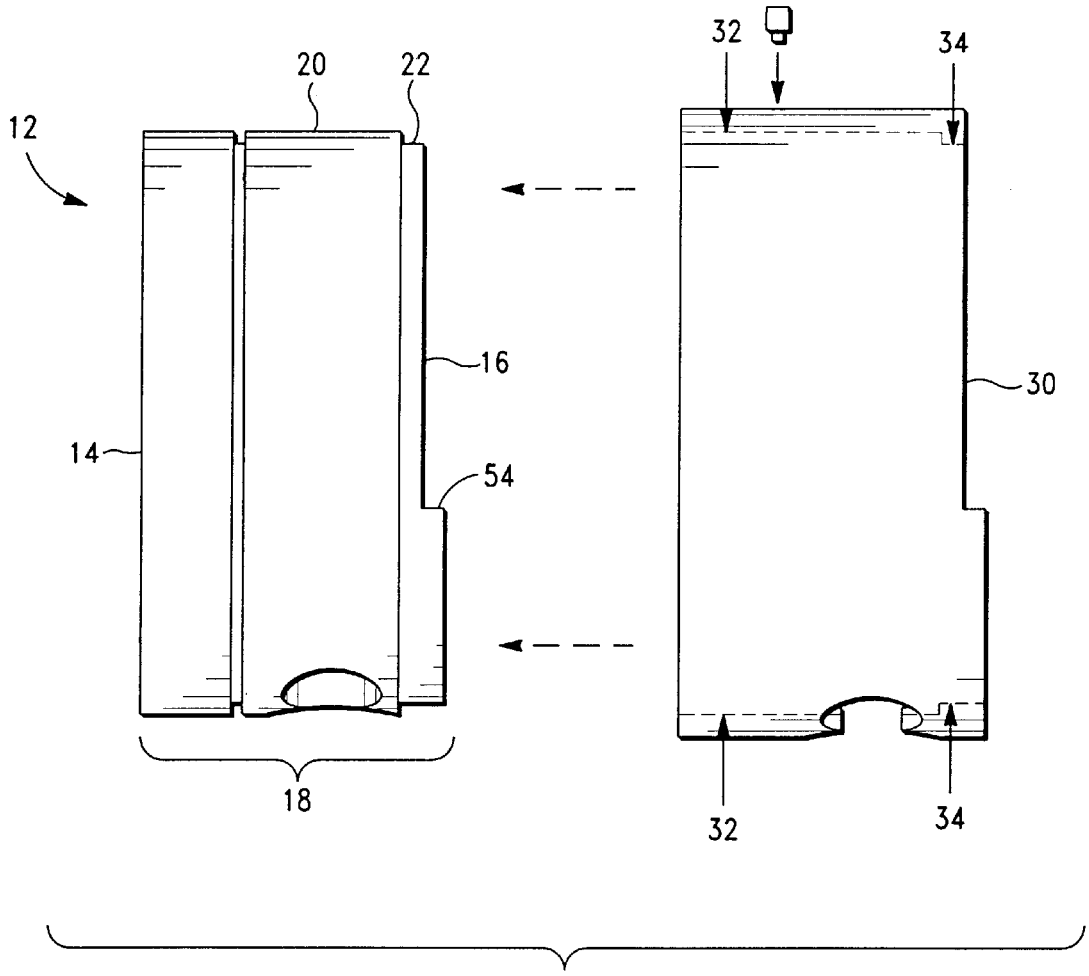
FIG. 3 presents the side elevation of the encasement and the side elevation of the slip ring.

Referring next to FIG. 3, the hollow, cylindrical slip ring 30 is slightly larger in diameter than the casing 12 and slides axially over the sidewall 18 of the casing 12. The slip ring 30 has a third inside diameter 32 that corresponds to the first and larger outside diameter 20 of the sidewall 18 of the casing 12. The slip ring 30 also has a fourth inside diameter 34 that corresponds to the second outside diameter 22 of the sidewall 18 of the casing 12. When the lock 10 is fully assembled, the first and second outside diameters 20, 22 of the casing 12 cooperate with the third and fourth inside diameters 32, 34 of the slip ring 30 prevent forward axial movement of the slip ring 30 when the slip ring 30 is coupled onto the casing 12.

Figure 4:
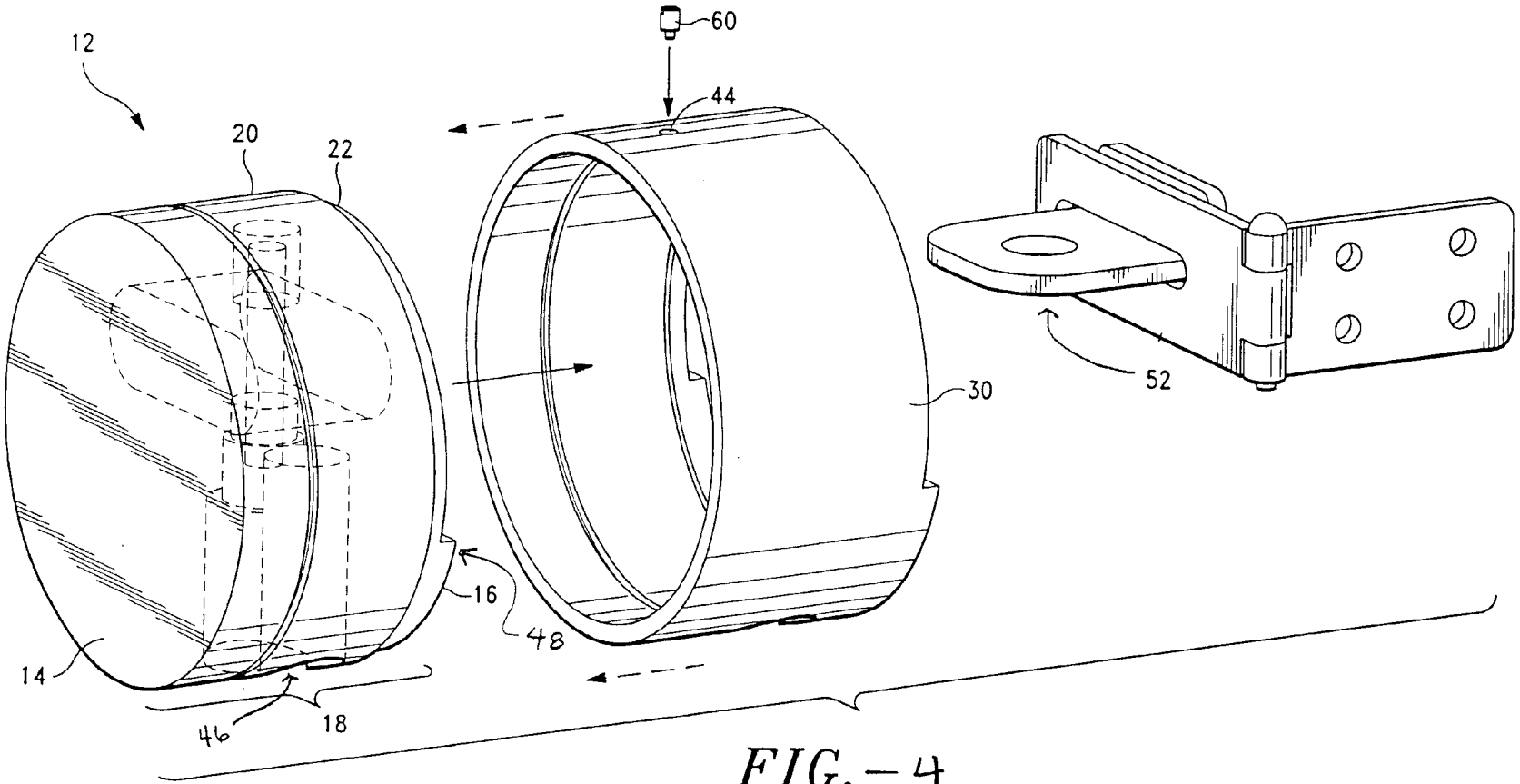
FIG. 4 presents a perspective of the lock casing and slip ring as they would be positioned onto a latch.
Figure 5:
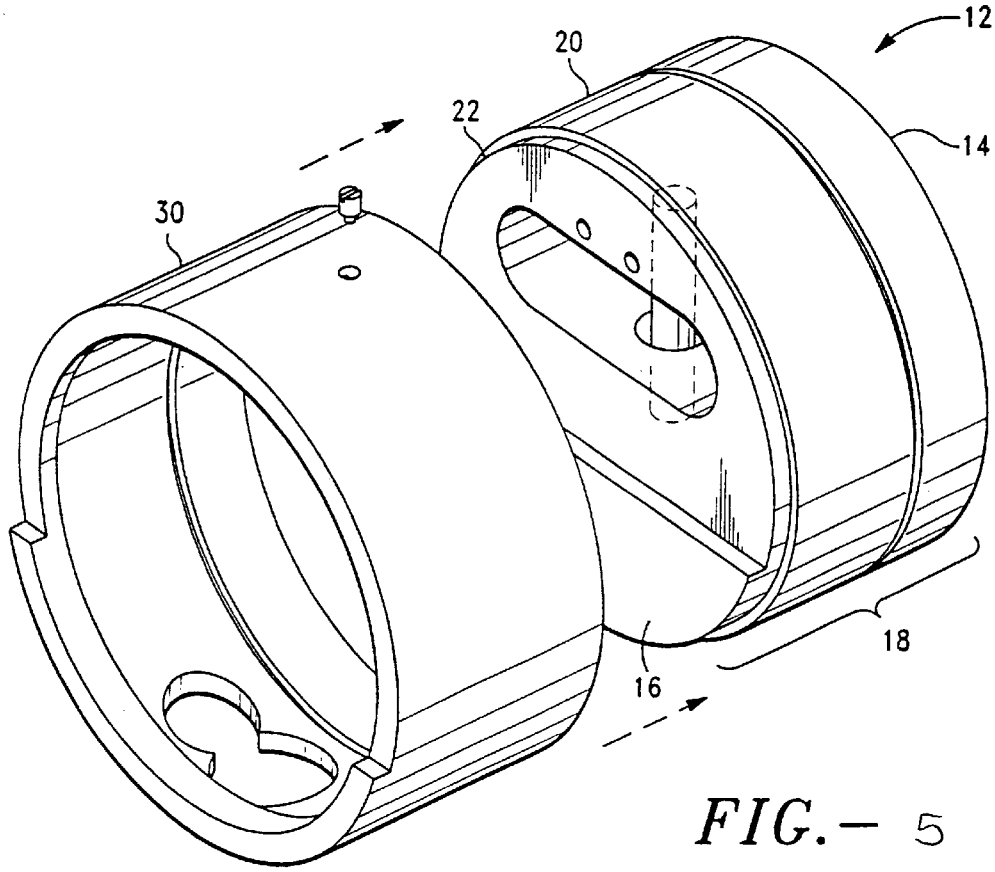
FIG. 5 presents a perspective, from the rear, of the lock casing and the slip ring.

Referring now to FIGS. 4 and 5, the casing 12 also has a smaller threaded opening 44 in the sidewall 18 of the casing 12 for a setscrew 60 to act as an alignment guide to align to casing 12 keyhole 46 with the slip ring 30 keyhole cut out.

The sidewall 18 of the padlock case 12 contains means for aligning the casing 12 keyhole opening 46 with the slip ring 30 opening. The setscrew 60 additionally prohibits the lateral movement of the slip ring 30 by affixing the screw 60 through the slip ring 30 and into a threaded opening 44 in the encasement 12.

In one embodiment, the lock 10 has a shelf 48 that extends backwards from the rear face 16. In an alternative embodiment, the rear face 16 has a planar surface.

The lock is assembled by coupling the slip ring 30 to the casing 12 by sliding the slip ring 30 axially from the rear of the casing 12 towards the front of the casing 12. When the differing diameters of the slip ring 30 and casing 12 meet, further forward axial movement of the slip ring 30 is prohibited. The slip ring 30 properly aligns with the casing 12 by inserting the setscrew 60 into the setscrew opening 44. The lock attaches to the device to be locked by sliding the lock axially towards the hasp 52 until the rear face 16 of the lock abuts the planar surface of the device to be locked. When the lock is fully assembled and in use, the slip ring 30 covers the sidewall 18 of the casing 12, the rear face 16 of the casing 12 abuts the exterior wall of the item being locked, and the shackle 42 of the lock 10 attaches vertically to the hasp 52 of the item to be covered. When the lock 10 is engaged, the shackle 42 passes through a hasp 52 that is firmly affixed to the item being secured.

In this manner, the casing 12 and slip ring 30 are properly aligned through the use of the setscrew and the lock 10 remains free from vandalism caused by the use of rotational/torque force.

The description of the present invention has been made with respect to specific arrangements and constructions of a lock that is resistant to being broken through torque or rotational movement. It will be apparent, to those skilled in the art that the foregoing description is for illustrative purposes only, and that changes and modifications can be made to the present invention without departing from the overall spirit and scope of the present invention. The full extent of the present invention is defined and limited only by the following claims.

What is claimed is:

1. A lock comprising:

a cylindrical lock encasement including;
- a front face;
- a sidewall;
- a rear face having a rounded rectangular shaped opening extending inward for less than the width of said sidewall for receiving a shackle and a hasp, said shackle designed to couple with said hasp attached to a device to be locked;
- a cavity extending inward from the surface of said sidewall towards the center of said encasement and adapted to receive a tumbler keyed locking mechanism;
- said sidewall having;
  - an opening adapted to receive a tumbler keyed locking mechanism and opening into said cavity;
  - a threaded opening for receiving a setscrew;
  - a circumferential groove passing over said threaded opening;
  - a first and a second diameter;

a slip ring capable of coupling to said encasement by sliding axially from the rear to the front of said encasement, having;
- an opening for allowing a key to be inserted into said tumbler keyed locking mechanism;
- an opening for allowing said setscrew to be received into said threaded opening for said setscrew;

said setscrew opening and said threaded opening located with respect to said sidewall opening and said slip ring opening such that inserting said setscrew aligns said sidewall opening over said slip ring opening;

a third inside and fourth inside diameter;

wherein said lock is resistant to torque force by the use of said slip ring axially attached to said case and said forward axial movement of said slip ring is precluded past said front face through the use of different circumferences on said sidewall and within the inside diameter of said slip ring.

2. The device of claim one wherein said rear face of said cylindrical encasement has a shelf in the upper one-half of said encasement that extends rearward beyond the planar surface of a lower one-half of said rear face such that a portion of said rear face can rest on a ledge surface with the remainder of said cylindrical encasement hanging over said ledge surface.

3. The device of claim one wherein;

said first diameter of said sidewall is positioned towards the front face of said lock casing;

said second diameter of said sidewall is positioned towards the front face of said lock casing;

said third diameter of said slip ring is positioned towards the front of said slip ring; and said fourth diameter of said slip ring is positioned towards the front of said slip ring.

4. The device of claim one wherein;

said first diameter of said sidewall is positioned towards the rear face of said lock casing;

said second diameter of said sidewall is positioned towards the rear face of said lock casing;

said third diameter of said slip ring is positioned towards the rear of said slip ring; and said fourth diameter of said slip ring is positioned towards the rear of said slip ring.

5. The device of claim one wherein said rear face of said cylindrical encasement has a shelf in the lower one-half of said encasement that extends rearward beyond the planar surface of said upper one-half of said rear face such that a portion of said rear face can rest on a ledge surfaces.

* * * * *